US010449548B2

(12) United States Patent
Schmit

(10) Patent No.: US 10,449,548 B2
(45) Date of Patent: Oct. 22, 2019

(54) GRINDING AND DRYING PLANT

(71) Applicant: PAUL WURTH S.A., Luxembourg (LU)

(72) Inventor: Louis Schmit, Luxembourg (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 16/063,644

(22) PCT Filed: Dec. 14, 2016

(86) PCT No.: PCT/EP2016/080929
§ 371 (c)(1),
(2) Date: Jun. 18, 2018

(87) PCT Pub. No.: WO2017/102810
PCT Pub. Date: Jun. 22, 2017

(65) Prior Publication Data

US 2019/0001339 A1 Jan. 3, 2019

(30) Foreign Application Priority Data

Dec. 17, 2015 (LU) ..... 92916

(51) Int. Cl.
*B02C 23/02* (2006.01)
*B02C 23/10* (2006.01)
(Continued)

(52) U.S. Cl.
CPC ..... *B02C 23/02* (2013.01); *B02C 21/00* (2013.01); *B02C 21/02* (2013.01); *B02C 23/10* (2013.01);
(Continued)

(58) Field of Classification Search
CPC ..... B02C 21/00; B02C 21/02; B02C 23/02; B02C 23/30; B02C 2021/023; B02C 23/10; B02C 23/24; B02C 23/18; F23G 5/033
(Continued)

(56) References Cited

U.S. PATENT DOCUMENTS 3,250,016 A * 5/1966 Agarwal ..... C21B 5/003 110/106
4,702,288 A * 10/1987 Ulveling ..... C21B 5/003 141/21
(Continued)

FOREIGN PATENT DOCUMENTS

DE 1200655 B 9/1965
GB 2129707 A 5/1984
(Continued)

OTHER PUBLICATIONS

International Search Report dated Mar. 23, 2017 re: Application No. PCT/EP2016/080929, pp. 1-3, citing: US 2002/023976 A1, GB 2 129 707 A, U.S. Pat. No. 5,353,997 A and DE 12 00 655 B.
(Continued)

*Primary Examiner* — Shelley M Self
*Assistant Examiner* — Smith Oberto Bapthelus
(74) *Attorney, Agent, or Firm* — Cantor Colburn LLP

(57) ABSTRACT

A method for producing a comminuted dry material from a coarse material, the method including: (a) providing a heated drying gas from a drying gas source; (b) providing the coarse material in a storage bin; (c) feeding the coarse material and the heated drying gas into a comminuting equipment; (d) comminuting and drying the coarse material within the comminuting equipment to obtain a comminuted dry material; (e) collecting a mixture of drying gas and comminuted dry material from the comminuting equipment
(Continued)

and feeding the mixture to a separator to separate the comminuted dry material from the drying gas; and (f) recycling at least part of the drying gas from step (e) as a preconditioning gas and feeding the preconditioning gas into a lower part of the storage bin to precondition the coarse material.

21 Claims, 2 Drawing Sheets

(51) Int. Cl.
*B02C 23/18* (2006.01)
*B02C 23/24* (2006.01)
*B02C 21/00* (2006.01)
*B02C 21/02* (2006.01)

(52) U.S. Cl.
CPC ..... *B02C 23/18* (2013.01); *B02C 23/24* (2013.01); *B02C 2021/023* (2013.01)

(58) Field of Classification Search
USPC ..... 241/17, 18, 19, 23, 24, 65, 57, 62, 79
See application file for complete search history.

(56) References Cited

U.S. PATENT DOCUMENTS 5,284,187 A * 2/1994 Schmit ..... C21B 5/003 141/1
5,316,224 A * 5/1994 Dobozy ..... B29B 17/02 241/20
5,353,997 A * 10/1994 Kasseck ..... B02C 15/00 241/17
8,517,290 B2 * 8/2013 Thiel ..... B02C 15/00 241/19
8,573,520 B2 * 11/2013 Goedert ..... B02C 23/30 241/18
9,228,132 B2 * 1/2016 Dickinson ..... C10G 1/02
2002/0023860 A1 * 2/2002 Rabiei ..... A61L 11/00 209/3
2002/0023976 A1 * 2/2002 Poeschl ..... B02C 21/00 241/18
2003/0122003 A1 7/2003 Schlesiger et al.
2010/0043675 A1 * 2/2010 Lohle ..... B02C 15/04 106/789
2010/0230518 A1 * 9/2010 Ewles ..... B03B 9/061 241/23
2010/0239467 A1 * 9/2010 Constantz ..... C01F 5/24 422/168
2011/0220745 A1 * 9/2011 Politi ..... B01J 2/22 241/18
2012/0186491 A1 * 7/2012 Cuypers ..... C03B 3/02 106/439
2013/0146686 A1 * 6/2013 Schlegel ..... B02C 23/08 241/17
2013/0152632 A1 * 6/2013 Frieden ..... C04B 5/00 65/19
2013/0199424 A1 * 8/2013 Abraham ..... B02C 13/14 110/205
2013/0206875 A1 * 8/2013 Solvi ..... C04B 5/06 241/3
2014/0217206 A1 * 8/2014 Collins ..... B02C 19/0056 241/3
2014/0352294 A1 * 12/2014 Solvi ..... C21B 3/08 60/517
2015/0308679 A1 * 10/2015 Delson ..... F26B 21/086 110/346

FOREIGN PATENT DOCUMENTS

JP 5712418 B2 3/1982
JP 2003181324 A 7/2003

OTHER PUBLICATIONS

Written Opinion dated Mar. 23, 2017 re: Application No. PCT/EP2016/080929, pp. 1-5, citing: US 2002/023976 A1, GB 2 129 707 A, U.S. Pat. No. 5,353,997 A and DE 12 00 655 B.
JP Office Action dated Dec. 4, 2018 re: Application No. P2018-531426, pp. 1-3, citing: JP P S57-12418B2, JP P2003-181324A.

* cited by examiner

GRINDING AND DRYING PLANT

TECHNICAL FIELD

The present disclosure generally relates to grinding and drying plants used for producing comminuted dry materials useful for a number of applications.

BACKGROUND ART

Grinding plants are used to comminute bulk material. Often such grinding plants also comprise drying equipment to simultaneously reduce the bulk material's moisture content. Typical examples of such grinding and drying plants are used to process granulated blast furnace slag for the production of cement or so-called coal grinding and drying plants to turn wet coarse raw coal into dry pulverized coal, to be injected into blast furnaces or fired in power plants.

In case the bulk material to be ground and dried is combustible, e.g. in the case of coal, the resulting product is explosive and special attention has to be paid to the design of the process and of the plant, in order either to prevent/avoid explosions, primarily by keeping the oxygen concentration in the gases in contact with the explosive material below the so-called lower explosion limit value (explosion preventing design) or to protect the equipment and the environment against the effects of such explosions (explosion protecting design).

In typical grinding and drying plants, comminution, normally grinding, and drying of the raw material is performed, largely in parallel, inside a comminuting equipment or mill. Coarse material is ground e.g. between rotating rollers, balls etc., and a rotating grinding table or bowl, and moisture is evaporated in contact with a hot drying gas. The drying gas conveys the ground material into a classifier, usually integrated into the top part of the mill. Coarse material is eliminated from the drying gas flow and returned onto the grinding table or bowl, the fine material is transported by the cooled-down waste drying gas with increased water vapor content into a downstream equipment for gas-solid-separation, usually a bag filter.

Although many improvements have been made so far in the conception and operation of such grinding and drying plants, it remains that the overall process is very cost intensive in terms of energy consumption.

BRIEF SUMMARY

The disclosure provides an enhanced method and plant for producing a comminuted dry material from a coarse material allowing for a more energy efficient operation.

Hence, in a first aspect, the present disclosure proposes a method for producing a comminuted dry material from a coarse material, the method comprising the steps of:

(a) providing a heated drying gas from a drying gas source;

(b) providing the coarse material in a storage bin;

(c) feeding said coarse material and said heated drying gas into a comminuting equipment;

(d) comminuting and drying said coarse material within said comminuting equipment to obtain a comminuted dry material;

(e) collecting a mixture of drying gas and comminuted dry material from the comminuting equipment and feeding the mixture to a separator to separate the comminuted dry material from the drying gas.

The method of the disclosure further comprises the step of (f) recycling at least part of the drying gas from step (e) as a preconditioning gas and feeding said preconditioning gas into a lower part of said storage bin to precondition the coarse material.

In a second aspect, the disclosure provides a grinding and drying plant arranged for implementing the method as described herein. In particular, the disclosure provides a grinding and drying plant for producing a comminuted dry material from a coarse material, the grinding and drying plant comprising: a source of heated drying gas for providing heated drying gas at a predefined temperature; a coarse material storage bin for temporarily storing said coarse material; a comminuting equipment for comminuting and drying said coarse material to obtain a comminuted dry material; a coarse material feeding equipment for feeding coarse material from said coarse material storage bin into the comminuting equipment; conduits for feeding said heated drying gas into the comminuting equipment; a separator downstream the comminuting equipment for collecting and separating the comminuted dry material from the drying gas. The grinding and drying plant of the disclosure further comprises recycling conduits downstream the separator for recycling at least part of the drying gas as a preconditioning gas to a lower part of the coarse material storage bin to precondition the coarse material within the coarse material storage bin.

The present disclosure is based on two major findings providing two major advantages. A first important advantage of the disclosure is that by recycling at least part of the drying gas to precondition the coarse material upstream of comminuting equipment, the comminuting equipment or mill can be of significantly lower capacity without compromising on end product quality.

Indeed, factors conditioning the required capacity of the mill primarily include the requested nominal product (ground and dried material) output flow rate, the grindability (softness) and the moisture content of the raw material and the fineness (grain size distribution parameters) of the product. Now, in the usual case that the grain size (range) of the raw material is by far larger than the grain size (range) of the product, e.g. by several decimal powers (mm versus μm), the impact of the raw material grain size on the mill capacity is negligible.

Furthermore, factors determining the required drying capacity primarily include the requested nominal product (ground and dried material) output flow rate, the moisture content of the raw material and the residual moisture content of the product. In the case of coal for example, the residual moisture content asked for is usually in the order of magnitude of 1% (while the value that can actually be achieved is conditioned by the actual moisture retention capacity of the coal brand considered, reflected by the sorption isotherms), whereas raw coal moisture may range up to about 15% for black coal, even higher for lignite and brown coal.

Hence, the impact of raw material moisture content on the capacity of the mill can thus be significant. The example in FIG. 1 shows the decrease of the output capacity when producing pulverized coal of 1% residual moisture content and 80%<90 μm grain size distribution, the impacting parameters being the raw material moisture content (on an as received basis, i.e. ratio of water to wet material) and the grindability, reflected by the Hardgrove index (HGI, Hardgrove Grindability Index).

Suppliers of mills usually offer their equipment in a series of units (mill sizes) with graded, increasing capacities or nominal product outputs for defined raw material and fine material (product) conditions. In parallel, the drying gas flow rate range acceptable in each unit or mill size is fixed, these ranges becoming larger and being shifted to higher value levels as the capacities or product outputs increase.

In other words, as the coarse starting material may be very variable in terms of moisture, the plant and especially the mill must be dimensioned so as to cope with all grades of starting materials, i.e. both relatively dry and very wet material. As an example, in the case of coal and the conditions of FIG. 1, reducing the moisture content of raw coal e.g. from 15% to 7% would reduce the required capacity by $[1/(\leq 0.8)]-1=(\geq 0.25)$, i.e. by 25% and more as compared to the initial value, depending on the grindability. Significant savings would actually occur at mill level in case and provided the reduction of the required capacity would actually result in the installation of a mill size smaller than the size to be considered in the original conditions.

In addition, the mill inlet temperature range of the hot drying gas being fixed, the moisture content of the raw material being already reduced by the preconditioning upstream the mill result as well in a significant reduction of the required drying gas flow rate, and thus of the size of the gas-solid-separation equipment (bag filter) and the throughput of the drying gas main fan, provided the reduced drying gas flow rate fits into the acceptable drying gas flow rate range of the mill, which is of course likely in case the mill size could be reduced as well, as explained above.

A second major advantage of the disclosure is that it allows for an easier and steadier operation of the grinding and drying process. Indeed, the apparently inevitable variability of the starting material puts a significant burden on the operator of the plant and any uncontrolled variation puts at risk the continuous production of comminuted material. Indeed, if the material is not sufficiently dried, it will agglomerate and not only produce unusable material, but also clog the downstream equipment especially the separators or filters.

This second major advantage is in fact due on the one hand to a reduced (and less fluctuating) temperature drop within the mill during material introduction and on the other hand to a more reliable drying with a reduced risk of clogging and unplanned plant shut-down. In other words, the disclosure provides a way to precondition the coarse material by preheating and/or predrying it or by reducing its variability both in terms of moisture and temperature, thereby facilitating operation and increasing reliability of the overall process.

In a further variant of the disclosure, step (f) comprises a sub-step (f1) of mixing the preconditioning gas with heated drying gas from the drying gas source before the feeding into the lower part of said storage bin. Hence, the grinding and drying plant preferably further comprises a mixing arrangement within the recycling conduits for mixing the preconditioning gas with heated drying gas from the drying gas source before the feeding into the lower part of said storage bin.

If necessary, step (f) comprises a sub-step (f2) of adjusting the pressure of the preconditioning gas before the feeding into the lower part of said storage bin. Adjusting the pressure may be required depending on the configuration of the storage bin and the coarse material to have an appropriate flow rate within the storage bin. In some embodiments, the pressure adjustment may be made with a fan installed in the conduits upstream (in the sense of the preconditioning gas flow) of the storage bin. Alternatively or additionally, a suction fan may be arranged within the conduit downstream of the storage bin or even downstream a further separator (see below).

Generally, the preconditioning gas is collected after the preconditioning at an upper part of said storage bin (sub-step (f3)). Hence, the coarse material storage bin preferably comprises a gas outlet arranged in an upper part thereof for collecting the preconditioning gas. As the preconditioning gas progresses through the coarse material, it becomes increasingly loaded with moisture and progressively cools down, the temperature of the preconditioning gas may fall below the dew point. It may therefore be advantageous to extract the preconditioning gas at a height below the top of the storage bin, i.e. at a point where the preconditioning gas has not passed through the entire filling height of coarse material.

The preconditioning gas leaving the storage bin may still contain fine material and if this gas is to be released to the atmosphere it might thus be necessary to filter said gas. Hence, the method preferably comprises a sub-step (f4) of feeding the preconditioning gas collected in sub-step (f3) to a further separator to separate any residual fine material from the preconditioning gas. The plant thus preferably comprises such a further separator downstream the gas outlet of the storage bin for separating any residual fine material from the collected preconditioning gas.

For a similar reason as above, it may be advantageous to mix the preconditioning gas collected in sub-step (f3) with additional heated drying gas from the drying gas source before the feeding to the further separator of sub-step (f4) in order to avoid that the gas temperature drops below the dew point in the further separator. The plant thus preferably provides for appropriate conduits and mixing arrangement.

The drying gas source in the context of the disclosure may be any appropriate source of hot gases, such as a drying gas generator. In particular, if available, such a source of hot gases may use hot off-gases from other processes in vicinity of the grinding and drying plant, preferably a low calorific value gas with low hydrogen content, such as blast furnace gas.

If necessary or desired, the drying gas source comprises a burner equipment with sufficient heating capacity to heat the drying gas at temperatures useful for drying the comminuted material. If the drying gas comes from other processes and already is at a relatively high temperature, a low capacity burner may be used to adjust the temperature as necessary.

The separator for collecting and separating the comminuted dry material from the drying gas (step (e)) can be one or more of any appropriate type, such as a bag filter, a cartridge filter, a cyclone, etc.

In a particularly preferred embodiment, all the drying gas from step (e) is recycled, part of it being used for the preconditioning of the coarse material in the storage bin and part of it being used to dry the comminuted material in the comminuting equipment or mill (step (d)). Preferably at least the part for use in step (d) is mixed with hot drying gas from the drying gas source. More preferably all of the drying gas is mixed with said hot drying gas. As all the drying gas is recycled the plant does not require an off-gas stack after the separator. A further advantage is that the separator therefor does not need to filter the drying gas to the same degree. Indeed, as all of the drying gas is recycled and not released to the atmosphere, it is acceptable to have a certain amount of residual fine material or dust in the gas. Hence, less demanding separators may be used, thereby reducing procurement and operating costs (less expensive, requiring less maintenance) and increasing reliability (being less prone to clogging). In particular preferred embodiments the separator is a cyclone type separator. Depending on the actual gas flows to be cleaned, the separator thus preferably comprises one or more cyclones, still more preferably two or more cyclones in parallel arrangement.

The storage bin containing the coarse material may be of any appropriate type, such as a conventional hopper with a lower tapered, generally conical outlet part. The storage bin may also have a flat bottom generally with means for conveying the material to the storage bin's outlet, such as a clearing arm conveyor, preferably provided with speed control.

The method and grinding and drying plant described herein may in principle be used for any coarse material to be comminuted and dried. Particularly preferred uses are grinding and drying of slag, such as blast furnace slag, or of coal, such as black coal, lignite or brown coal.

BRIEF DESCRIPTION OF THE DRAWINGS

Preferred embodiments of the disclosure will now be described, by way of example, with reference to the accompanying drawings in which.

Further details and advantages of the present disclosure will be apparent from the following detailed description of several not limiting embodiments with reference to the attached drawings.

DESCRIPTION OF PREFERRED EMBODIMENTS

Figure 1:
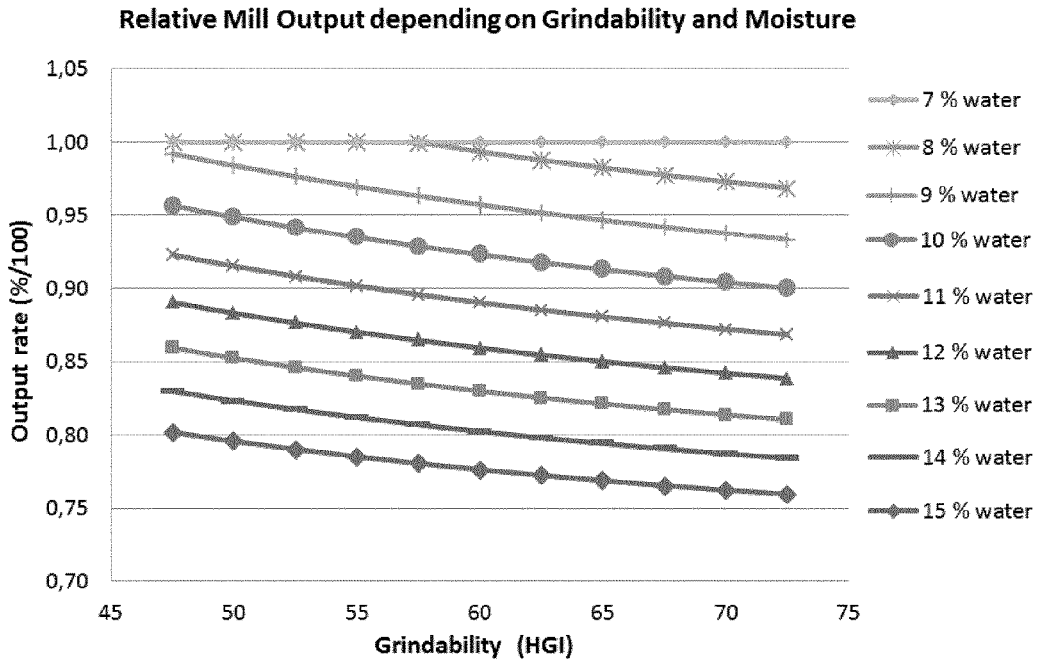
FIG. 1 is a diagram illustrating an example of relative mill output depending on grindability and moisture.

FIG. 1 shows a diagram illustrating an example of relative mill output depending on grindability and moisture. In fact, this example shows the decrease of the output capacity when producing pulverized coal with 1% residual moisture content and 80%<90 μm grain size distribution. The impacting parameters are the raw material moisture content (on an as received basis, i.e. ratio of water to wet material) and the grindability, reflected by the Hardgrove Grindability Index (HGI). As can be clearly seen in FIG. 1 and further explained above, the impact of raw material moisture content on the capacity of the mill can be significant.

Figure 2:
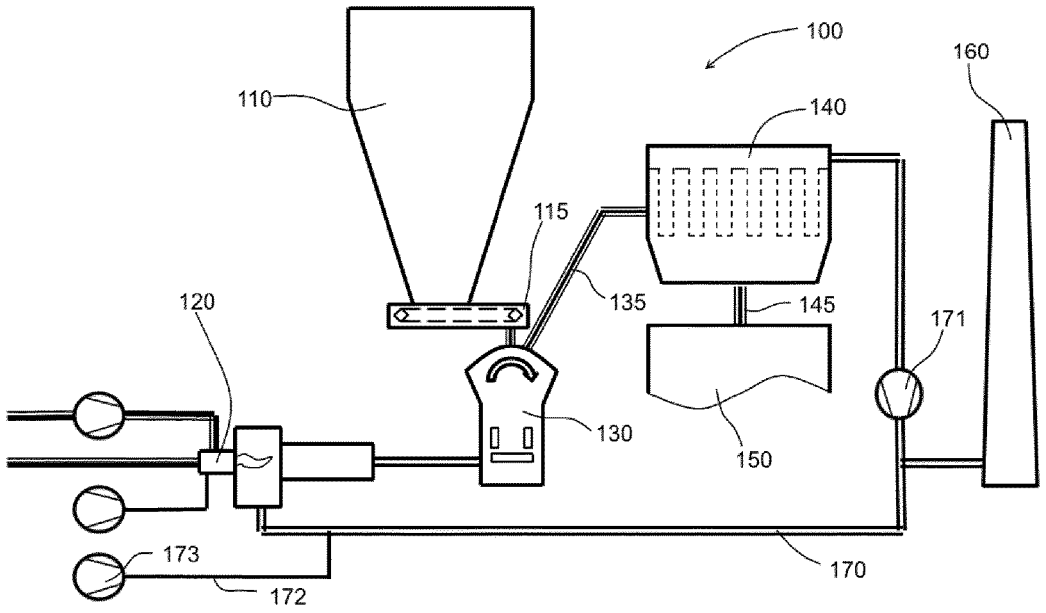
Fig. 2 (Prior art)
FIG. 2 is a schematic of a conventional grinding and drying plant for comminuting coarse material into comminuted dry material.

FIG. 2 shows a conventional (prior art) explosion preventing type design of a grinding and drying plant 100, especially of a coal grinding and drying plant.

Raw material, e.g. coarse slag or coal is stored in a raw material storage bin 110 upstream the mill 130. In order to be processed into dried pulverized material, e.g. pulverized slag or coal, raw material is preferably supplied into the mill 130 by means of a variable speed (variable capacity) conveyor 115, e.g. a variable speed drag chain conveyor and/or a rotary valve. The through-put of the conveyor conditions, within the grinding and drying capacity limits of the plant, the actual output of the grinding and drying plant.

In case the bulk material to be ground and dried is combustible, e.g. in the case of coal, the resulting product is explosive and special attention has to be paid to the design of the process and of the plant, in order either to prevent/avoid explosions, primarily by keeping the oxygen concentration in the gases in contact with the explosive material below the so-called lower explosion limit value (explosion preventing design) or to protect the equipment and the environment against the effects of such explosions (explosion protecting design).

Drying energy is supplied by a variable capacity drying gas generator 120, fired with a combustible gas. As far as available, the combustible gas is preferably a low calorific value gas with low hydrogen content, e.g. blast furnace gas. Low hydrogen content limits the water vapor content of the drying gas produced, thus increasing the drying efficiency. The drying gas generator 120 generally also includes a combustion air fan and an additional low capacity burner for high calorific value combustion gas, e.g. natural gas or coke oven gas, required for heating up the plant and possibly for supporting the combustion of the low calorific value combustion gas. As the close to stoichiometric combustion—avoiding high oxygen concentration in the flue gas—even of a low calorific value combustion gas—results in hot flue gas temperature levels in the order of magnitude of 1,000° C. and above, i.e. several times higher than what is acceptable inside the mill and in contact with the wet raw material, especially coal, to be dried, the hot flue gas produced inside the drying gas generator 120 has to be mixed up with a large flow rate of recycled waste drying gas, of about 100° C., from conduit 170 in order to get an appropriate drying gas temperature in front of the mill, in the range of about 200 to 350° C. in case of coal, the actual value required being primarily conditioned by the moisture content of the raw material.

When available, hot off-gases from other processes, of suitable temperature range and limited oxygen content, may be used to replace at least partly, in ideal conditions whole of the drying gas produced by burning combustion gas in the drying gas generator.

In typical grinding and drying plants 100, comminution, normally grinding, and drying of the raw material is performed, largely in parallel, inside the mill 130. Material is ground e.g. between rotating rollers, balls etc., and a rotating grinding table or bowl, and moisture is evaporated in contact with the hot drying gas. The drying gas conveys the ground material into a classifier, usually integrated into the top part of the mill 130. Coarse material is eliminated from the drying gas flow and returned onto the grinding table or bowl, the fine (comminuted) material is transported by the cooled-down waste drying gas with increased water vapor content through conduit 135/235 into a downstream filter equipment 140 for gas-solid-separation, usually a bag filter.

Pulverized material separated from the waste drying gas is transferred through conduit 145/245 into a downstream storage or conveying equipment 150, e.g. a fine material/product (pulverized coal) storage bin, a conveying hopper, a powder pump etc.

The waste drying gas is aspirated by the drying gas main fan 171, part of it is released as off-gas through the stack 160 into atmosphere, equaling the input of hot flue gas, evaporated moisture, false air etc., the balance is returned to the drying gas generator 120 through conduit 170, to be mixed up with the hot flue gas produced in the burner(s) of said generator 120.

In coal grinding, before startup, the plant 100 is flushed by means of an inert gas, normally nitrogen, bringing the oxygen concentration below the lower explosion limit value. In operation, most of the gas input, flue gas, water vapor, have a limited oxygen concentration, which, in combination with the oxygen release in the waste drying off-gas through the stack 160, keeps the oxygen concentration low and thus the plant in inert, explosion preventing conditions.

While keeping the drying gas circuit in inert conditions, it may be useful to inject complementary air, frequently called dilution air, through conduit 172/272 into that circuit, up to the maximum allowable oxygen concentration. This input of cold air additionally (slightly) increases the required drying energy output of the drying gas generator 120, i.e. more flue gas is produced. The combined additional input of air and flue gas, balanced by an increased off-gas flow rate, reduces the water vapor content of the drying gas, the dew point in the drying gas is lowered and drying efficiency is increased. The dilution air is supplied by a dedicated fan 173/273, shown next to the drying gas generator 120 in FIG. 2.

Figure 3:
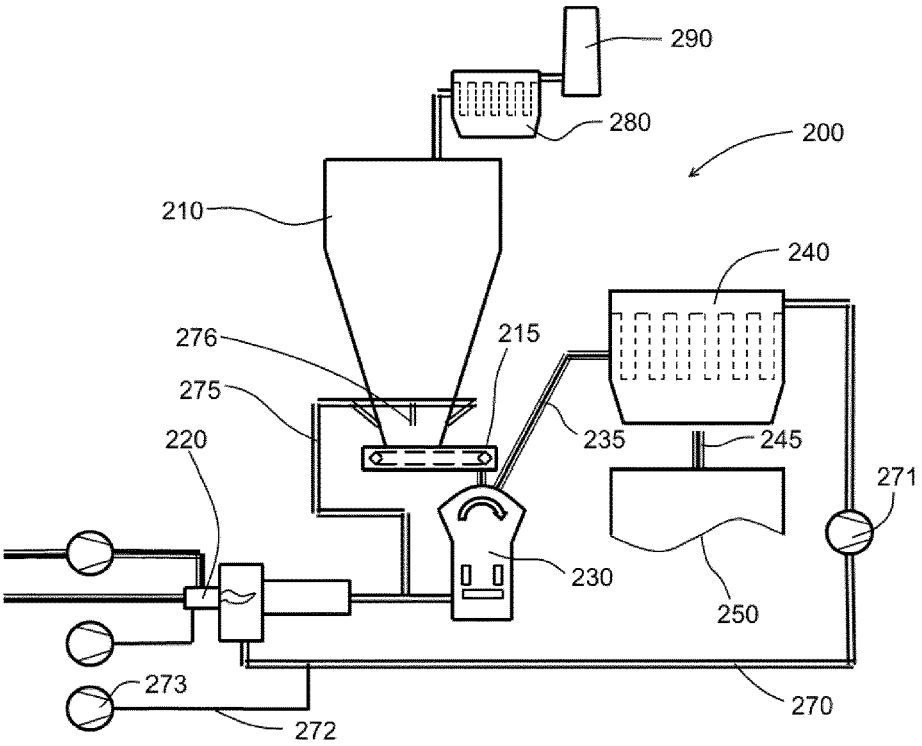
FIG. 3 is a schematic of a first embodiment of a grinding and drying plant of the present disclosure for comminuting coarse material into comminuted dry material.
Figure 4:
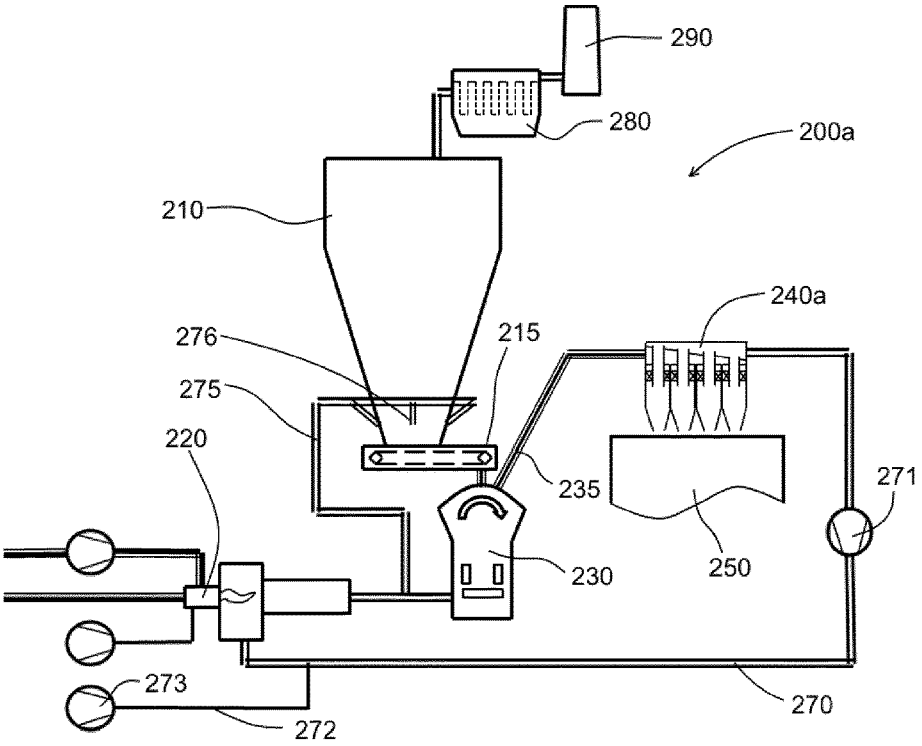
FIG. 4 is a schematic of a second embodiment of a grinding and drying plant of the present disclosure for comminuting coarse material into comminuted dry material.

In the embodiment of a grinding and drying plant 200 shown in FIG. 3, instead of releasing part of the waste drying gas through an off-gas stack 160 (see FIG. 2) downstream the drying gas main fan, whole of the waste drying gas is recycled through conduit 270 to the drying gas generator 220 and mixed with hot flue gas to produce hot drying gas with the appropriate mill inlet temperature level. A larger part of this hot drying gas is then generally supplied to the mill 230, the balance is supplied to the raw material storage bin 210 via conduit 275 and injected into the lower (conical) part of the bin 210 through inlets 276. The hot drying gas injected into the bin 210 flows through the raw material bed, heats the raw material up, evaporates part of the raw material moisture, is cooled down and leaves the bin 210 at the top. The waste drying gas leaving the raw material storage bin 210 is cleaned in a downstream off-gas bag filter 280 and finally released into atmosphere through off-gas stack 290; the fine solid material separated from the off-gas is transferred into the fine material/product bin 250. The raw material of decreased moisture content is transferred from the raw material storage bin 210 into the mill 230, to be processed into dried fine material. The storage bin 210 can be a conventional hopper with a lower tapered outlet part as shown in FIGS. 3 and 4. Alternatively, the storage bin 210 may be conceived with a flat bottom in which case it generally integrates means for conveying the material to the storage bin's outlet, such as a clearing arm conveyor 215, preferably provided with speed control.

As compared to the conventional design of FIG. 2, the reduced raw material moisture content upstream the mill 230 results in a reduced drying gas flow rate to be supplied to the mill 230 (within the limits of the drying gas flow rate range fixed by the mill), (as conditioned by this drying gas flow rate) a reduced gas-solid-separation equipment 240 (bag filter) size, a reduced through-put of the drying gas main fan 271 and finally a reduced mill 230 size. The capacity of the drying gas generator 220, however, basically remains the same, additional drying energy being supplied into the raw material storage bin 210, respectively the total moisture amount to be eliminated (raw material to be heated up, water to be heated up and to be evaporated) remaining unchanged.

The pressure level in the circuit is controlled (via the control of the off-gas flow) in such a way as to have downstream the drying gas generator 220 and upstream the mill 230 and the raw material storage bin 210 an appropriate overpressure level for conveying the given drying gas flow rate through the raw material storage bin 210 and the downstream bag filter 280 and stack 290 (off-gas pipe) into atmosphere. Alternatively or additionally, the pressure level downstream the drying gas generator 220 and upstream the mill 230 and the raw material storage bin 210 can be fixed at a lower level, while the drying gas flow through the raw material storage bin 210 and the downstream bag filter 280 and stack 290 (off-gas pipe) into atmosphere is conveyed by an additional suction fan (not shown) installed downstream the bin 210 or the off-gas bag filter 280.

Depending on the filling level of the raw material storage bin 230 when starting the input of hot drying gas into that bin, the waste drying gas leaving the bin could have been cooled-down to a temperature level close to or below the dew point, which would strongly impair the operation of the downstream off-gas bag filter 280. In a preferred embodiment, an additional hot drying gas line may be installed, by-passing the raw material storage bin 210 and allowing mixing cold waste drying gas with hot drying gas in order to reach an appropriate temperature level in front of the off-gas bag filter 280. In case of a large capacity raw material storage bin, it is also contemplated to have the drying gas to solid material heat exchange and water evaporation only take place in the lower part of the bin, and have the waste drying gas leave the bin 210 at a level lower than the top.

The design of the grinding and drying plant with a preconditioning step according to the disclosure avoids or reduces a significant disadvantage of a conventional design sized for a (potentially) high inlet moisture content, in case this conventional design has to be operated with raw material of an actual moisture content significantly lower than the design moisture content and/or at an output flow rate significantly lower than the design output flow rate, this disadvantage being the substantially increased specific electrical energy requirement of the mill, when this mill is operated at a capacity level or grinding energy input significantly lower than its nominal input.

The solution outlined above having aimed at reducing the size and capacity of the equipment to be installed in a new plant, in order to reach a given fine material capacity or product output, may in principle as well be used to increase the capacity of an existing plant, provided the limitation of the capacity is in the mill and caused by a high moisture content of the raw material. In this case, the capacity of the drying gas generator might have to be increased; respectively an additional drying gas generator might have to be installed, to heat up the gas to be supplied into the raw material storage bin. In case the existing raw material storage bin cannot accommodate the additional equipment required for the predrying of the raw material, it may be suitable as well to install an additional bin, specifically dedicated to and sized for the heat transfer from the drying gas to the raw material, upstream the existing raw material storage bin.

Further potential cost savings are possible with an embodiment as shown in FIG. 4. This embodiment of a grinding and drying plant **200*a* includes the installation of a multiple cyclone 240*a* instead of the bag filter downstream the mill 230, as whole of the waste drying gas is recycled to the mill 230 or supplied to the raw material storage bin 210**, respectively no waste drying gas is released downstream the initially considered bag filter into atmosphere. The residual solid material content in the waste drying gas is significantly higher downstream a multiple cyclone than downstream a bag filter, but the equipment costs are significantly lower. Conversely, the dust content to be expected in the waste drying off-gas downstream the raw material storage bin is low and the installation of a cartridge filter rather than of a conventional bag filter may reduce equipment costs in that area.

The raw material preconditioning concept described herein has been analyzed for the case of an existing 50 t/h coal grinding and drying plant, producing 80%<90 μm pulverized coal out of raw coal of nominal 12% water content. It would be possible to replace the initially required mill by the next smaller size and reduce the capacity of the bag filter and the main drying gas fan. In nominal conditions, i.e. 50 t/h of 80%<90 μm pulverized coal out of raw coal of 50 HGI grindability and 12% water as received, the reduction of the total electrical process energy requirement has been estimated to amount to about 22%, primarily due to the lower requirement of the mill (lower moisture content) and of the drying gas main fan (lower waste drying gas flow rate).

The invention claimed is:

1. A method for producing a comminuted dry material from a coarse material, the method comprising the steps of:

(a) providing a heated drying gas from a drying gas source;

(b) providing the coarse material in a storage bin;

(c) feeding said coarse material and said heated drying gas into a mill;

(d) comminuting and drying said coarse material within said mill to obtain a comminuted dry material;

(e) collecting a mixture of drying gas and comminuted dry material from the mill and feeding the mixture to a separator to separate the comminuted dry material from the drying gas; and (f) recycling at least part of the drying gas from step (e) as a preconditioning gas and feeding said preconditioning gas into a lower part of said storage bin to precondition the coarse material, wherein the preconditioning gas evaporates part of a moisture of the material, leaves the storage bin and is finally released to the atmosphere.

2. The method as claimed in claim 1, wherein step (f) comprises a sub-step (f1) of mixing the preconditioning gas with heated drying gas from the drying gas source before the feeding into the lower part of said storage bin.

3. The method as claimed in claim 1, wherein step (f) comprises a sub-step (f2) of adjusting the pressure of the preconditioning gas before the feeding into the lower part of said storage bin.

4. The method as claimed in claim 1, wherein step (f) comprises a sub-step (f3) of collecting the preconditioning gas at an upper part of said storage bin.

5. The method as claimed in claim 4, wherein step (f) comprises a sub-step (f4) of feeding the preconditioning gas collected in sub-step (f3) to a further separator to separate any residual fine material from the preconditioning gas before the preconditioning gas is released to the atmosphere.

6. The method as claimed in claim 5, wherein the preconditioning gas collected in sub-step (f3) is mixed with heated drying gas from the drying gas source before the feeding to the further separator of sub-step (f4).

7. The method as claimed in claim 1, wherein the drying gas source provides hot off-gases from other processes.

8. The method as claimed in claim 7, wherein hot off-gases from other processes comprise blast furnace gas.

9. The method as claimed in claim 1, wherein the drying gas source comprises a burner equipment.

10. The method as claimed in claim 1, wherein the separator in step (e) comprises one or more cyclones.

11. The method as claimed in claim 1, wherein the coarse material is slag or coal.

12. A grinding and drying plant for producing a comminuted dry material from a coarse material, the grinding and drying plant comprising:

a source of heated drying gas at a predefined temperature;

a coarse material storage bin comprising said coarse material;

a mill configured for comminuting and drying said coarse material to obtain a comminuted dry material;

a conveyor configured for feeding coarse material from said coarse material storage bin into the mill;

a plurality of conduits configured for feeding said heated drying gas into the mill;

a separator disposed downstream the mill configured for collecting and separating the comminuted dry material from the drying gas; and a plurality of recycling conduits disposed downstream the separator and configured for recycling at least part of the drying gas as a preconditioning gas to a lower part of the coarse material storage bin to precondition the coarse material within the coarse material storage bin, wherein the storage bin comprises a gas outlet configured for releasing the preconditioning gas comprising part of a moisture of the material into the atmosphere.

13. The grinding and drying plant as claimed in claim 12 comprising a mixing arrangement disposed within the recycling conduits configured for mixing the preconditioning gas with heated drying gas from the drying gas source before the feeding into the lower part of said storage bin.

14. The grinding and drying plant as claimed in claim 12, comprising a pressure adjustment component configured for adjusting the pressure of the preconditioning gas before the feeding into the lower part of said storage bin.

15. The grinding and drying plant as claimed in claim 12, wherein the coarse material storage bin comprises a gas outlet arranged in an upper part thereof for collecting the preconditioning gas.

16. The grinding and drying plant as claimed in claim 15 comprising a further separator downstream the gas outlet for separating any residual fine material from the collected preconditioning gas before the preconditioning gas is released to the atmosphere.

17. The grinding and drying plant as claimed in claim 12, wherein the drying gas source is arranged for providing hot off-gases from other processes.

18. The grinding and drying plant as claimed in claim 17, wherein hot off-gases from other processes comprise blast furnace gas.

19. The grinding and drying plant as claimed in claim 12, wherein the drying gas source comprises a burner equipment.

20. The grinding and drying plant as claimed in claim 12, wherein the separator for collecting and separating the comminuted dry material from the drying gas comprises one or more cyclones.

21. The grinding and drying plant as claimed in claim 12, wherein the coarse material is slag or coal.

* * * * *